US006029822A

United States Patent [19]

Skoropa

[11] Patent Number: 6,029,822

[45] Date of Patent: Feb. 29, 2000

[54] DRIVE SYSTEM FOR A VIBRATORY SCREENING PLANT

[76] Inventor: Allan Skoropa, 5919 Red Coat La., W. Bloomfield, Mich. 48322

[21] Appl. No.: 08/986,296

[22] Filed: Dec. 6, 1997

[51] Int. Cl.[7] ..... B07B 1/34

[52] U.S. Cl. ..... 209/326; 209/325; 209/332; 209/366.5; 209/367

[58] Field of Search ..... 209/325, 326, 209/331, 332, 366, 366.5, 367

[56] References Cited

U.S. PATENT DOCUMENTS

| | | | |
|---|---|---|---|
| 1,999,768 | 4/1935 | Lincoln | 209/366 |
| 2,856,073 | 10/1958 | Amori | 209/366.5 |
| 3,444,999 | 5/1969 | Hurst | 209/332 |
| 3,608,388 | 9/1971 | Huber | 209/366.5 |
| 4,256,572 | 3/1981 | Read | 209/325 |
| 4,262,549 | 4/1981 | Schwellenbauch | 209/367 |

*Primary Examiner*—Donald P. Walsh
*Assistant Examiner*—Joe Dillon, Jr.

[57] ABSTRACT

A vibratory screening device includes a frame and a screen, supported by the frame, for separating undersize and oversize material. A vibrating device, coupled to the screen includes a first output shaft with an axis of rotation that oscillates relative to the frame. The vibrating device oscillates the screen as the first output shaft is rotated. A driver includes a second output shaft with an axis of rotation that is fixed relative to the frame. The driver rotates the first output shaft. A connector mechanically couples rotational output of the first output shaft to the second output shaft. Preferably, the connector includes a first universal joint, a sliding spline shaft, and a second universal joint. The driver preferably includes an engine, a centrifugal clutch coupled to the first output shaft, a sheave, and an endless belt connecting the centrifugal clutch to the sheave.

15 Claims, 7 Drawing Sheets

DRIVE SYSTEM FOR A VIBRATORY SCREENING PLANT

BACKGROUND OF THE INVENTION

1. Technical Field

This invention relates to portable vibratory material screening devices and, more particularly, to an improved drive system for portable vibratory material screening devices.

2. Background

Portable vibratory screening devices typically include a supporting frame, heavy duty springs, a screen box with a material separating screen, a drive system and an eccentric shaft. The frame and springs support the screen box and screen for vibratory movement above the ground. The drive system provides torque to rotate the eccentric shaft that is fixedly attached to the screen box.

The eccentric shaft typically includes eccentric weights which cause a dynamic rotational imbalance when the eccentric shaft is rotated. In other words, the eccentric shaft vibrates the screen box when the drive system rotates the eccentric shaft. A loading device such as wheel loaders, skid steers, conveyors or other devices load top soil or other materials to be screened onto the screen box. Because the screen box vibrates, undersize material falls through the screen while oversize material remains on the screen. The screen box is often positioned at an angle relative to the ground to allow the oversize material to vibrate off the screen to make room for additional material to be screened.

The coupling between the output shaft of the drive system and the eccentric shaft has posed several problems. For durability reasons, the drive system must be isolated from the eccentric shaft due to the vibrating movement of the eccentric shaft. Conventional drive system typically utilize a gas or diesel engine or an electric motor that powers a hydraulic pump. Hydraulic hoses and a valve body connect the hydraulic pump to a hydraulic motor that vibrates with the eccentric shaft. While the engine or motor and the hydraulic pump are isolated from the vibration, the hydraulic motor is not. Due to the absence of isolation, the vibration significantly decreases the life of the hydraulic motor. In addition, the hydraulic hoses experience increased failures due to the vibrational fatigue. When these hoses begin leaking, the hydraulic fluid is released causing environmental hazards which can be costly to clean.

Conventional vibratory screening devices also typically require an operator to engage levers or clutches located in the engine compartment during startup engage the drive system. Opening the compartment during startup or while the drive system is operating poses a safety hazard to the operator.

Accordingly, it is an object of the present invention to provide a simple drive system for a vibratory screening plant which eliminates the need for a hydraulic pump, a hydraulic motor and hydraulic hoses. It is another object of the present invention to provide simple drive system and coupling for driving an eccentric shaft. It is yet another object of the present invention to provide a drive system for a vibratory screening device which has a simple starting procedure. These objects and others are achieved by the present invention described hereinafter.

SUMMARY OF THE INVENTION

A vibratory screening device according to one aspect of the present invention includes a frame and a screen, supported by the frame, for separating undersize and oversize material. A vibrating device, coupled to the screen includes a first output shaft with an axis of rotation that oscillates relative to the frame. The vibrating device oscillates the screen as the first output shaft is rotated. A driver includes a second output shaft with an axis of rotation that is fixed relative to the frame. The driver rotates the first output shaft. A connector mechanically couples rotational output of the first output shaft to the second output shaft.

In another feature of the invention, the connector preferably includes a first universal joint coupled to a sliding spline shaft and a second universal joint coupled to the sliding spline shaft. The driver preferably includes an engine, a centrifugal clutch coupled to the first output shaft, a sheave, and an endless belt connecting the centrifugal clutch to the sheave.

In still another feature of the invention, a mounting pad is connected to the frame and first and second pillow block bearings are connected to the mounting pad. A third output shaft has a first portion rotatably supported by the first pillow block bearing and a second portion rotatably supported by the second pillow block bearing. The sheave is supported between the first and second portions.

Other objects, features and advantages will be apparent to skilled artisans. The present invention will be further understood, both as to its structure and operation, from the accompanying drawings, taken in conjunction with the accompanying description, in which similar reference characters refer to similar parts.

BRIEF DESCRIPTION OF THE DRAWINGS

The various advantages of the present invention will become apparent to those skilled in the art after studying the following specification and by reference to the drawings in which.

DESCRIPTION OF THE PREFERRED EMBODIMENT

Figure 1:
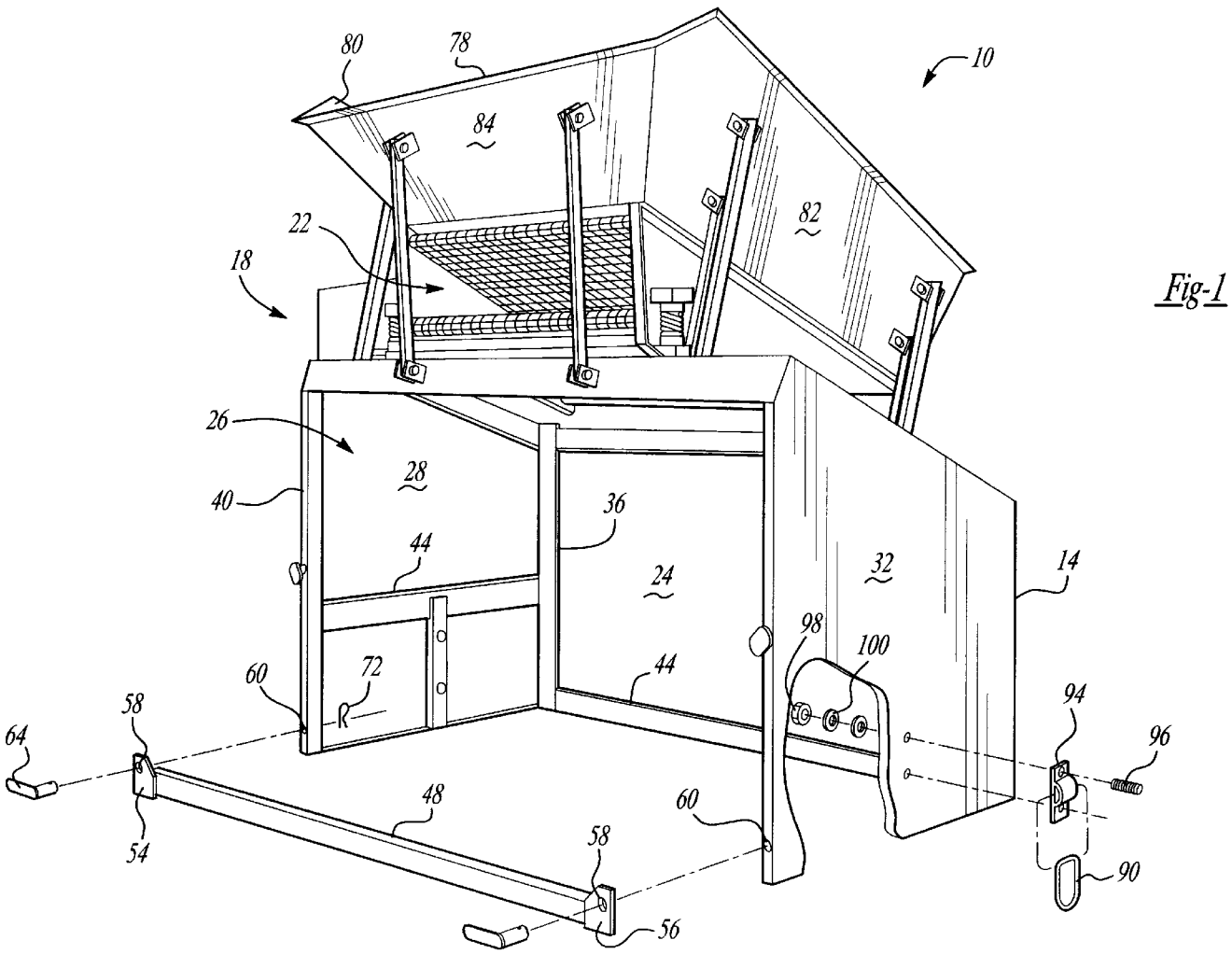
FIG. 1 is a perspective view of a rear side of a vibratory screening device according to the present invention.

Referring to FIG. 1, a portable material screening plant 10 according to the invention is shown and includes a box frame 14 which supports a vibratory drive system 18 and a screening assembly or screen box 22. Box frame 14 preferably includes an enclosed front 24 and an open rear 26. Opposing sides 28 and 32 of box frame 22 are preferably closed. Box frame 14 includes front and rear vertical support members 36 and 40 that support opposing corners of box frame 14. One or more horizontal support members 44 connect front and rear vertical support members 36 and 40, opposing front vertical support members 36 and/or opposing rear vertical support members 40.

A lower horizontal support member 48 is removably connectable to a lower end of the rear vertical support members 40 adjacent the ground. Removable lower horizontal support member 48 preferably includes first and second coupling plates 54 and 56 each with a bore 58. Vertical support members 40 likewise include a bore 60. To connect horizontal support member 48 to frame 14, bores 58 of removable horizontal support member 48 are aligned with bores 60 on vertical support members 40. A pin 64, which is preferably "L"-shaped and has a bore 70, is inserted into bores 58 and 60. A key 72 is inserted into bore 70 to lock pins 64 and removable horizontal support member 48 in place.

A material loading guide 78 includes first, second and third material directing surfaces 80, 82 and 84 that are mounted to frame 14 above screening assembly 22 and independently of screen assembly 22. Material loading guide 78 directs material from loading devices such as a wheel loaders, skid steer loaders, conveyors, hoppers or other devices onto screening assembly 22. Preferably, first and second material directing surfaces 80 and 82 lie above opposing sides 28 and 32 of frame 14. Third planar surface 84 abuts rear edges of first and second planar surfaces 80 and 82.

One or more pivoting handles 90 are attached to the sides 28 and 32 of the frame 22 using a handle bracket 94, bolts 96, nuts 98 and washers 100. Pivoting handles facilitate loading and unloading of portable material screening plant 10 from a trailer or other transport devices.

Figure 2:
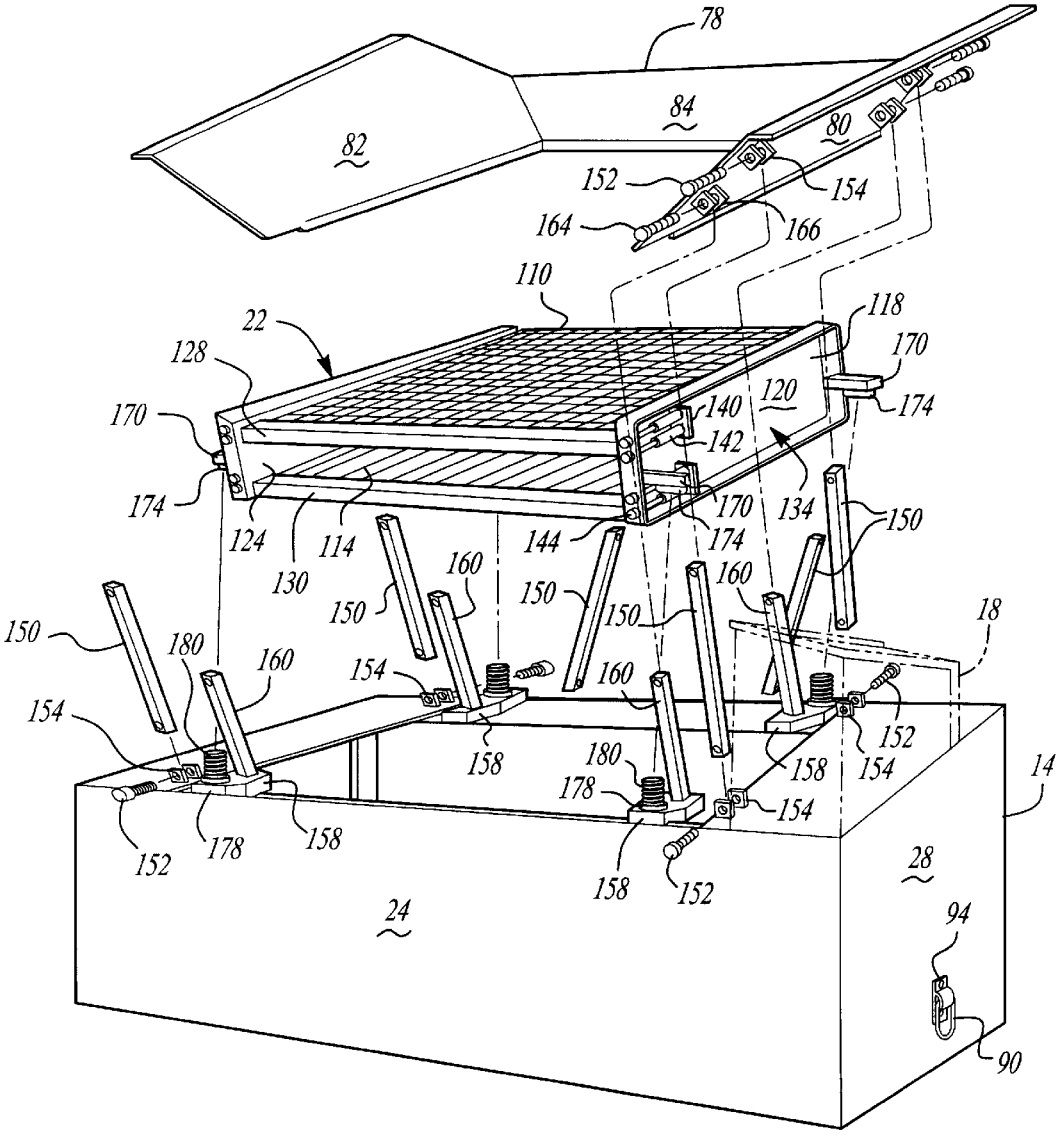
FIG. 2 is an assembly view of a front side of the vibratory screening device of FIG. 1.

Referring now to FIG. 2, the front side of frame 22 is illustrated. First and second upper surfaces 104 and 106 partially enclose the top surface of frame 14. Screen assembly 22 includes upper and lower screen decks 110 and 114 that are joined together by a screen assembly frame 118 with side supporting members 120 and 124 and upper and lower cross-members 128 and 130.

Screen tensioning devices 134 provide force against one edge of each screen deck 110 and 114 to provide tension in the screen decks as will be described further below in conjunction with FIGS. 3 and 4. Flanges 138 project from a front edge of side supporting members 120 and 124. A tensioning member 138 includes first and second threaded housings 140 that are mounted to an end plate 142. Bolts 144 are threaded through a bore in flanges 138 into first and second threaded housings 140.

Material loading guide 78 is connected to box frame 14 independently of screening assembly 22. A first set of arms 150 extends between box frame 14 and an outer surface of material loading guide 78. Bolts 152 and connecting plates 154 connect one end of arms 150 to an upwardly facing surface of box frame 14 and an opposite end of arm 150 to material loading guide 78. Supporting brackets 158 are welded to an upper portion of box frame 22. One end of a second set of arms 160 is welded to supporting brackets 158. Bolts 164 and plates 166 connect an opposite end of arms 160 to material loading guide 78.

Supporting plates 170 and downwardly facing circular flanges 174 are connected to side supporting members 120 and 124. Upwardly facing flanges 178 are connected to supporting brackets 158. When assembled, heavy-duty springs 180, which are positioned by and between flanges 174 and 178, support the corners of screen assembly 22 for vibratory and reciprocating screening movement.

Figure 3:
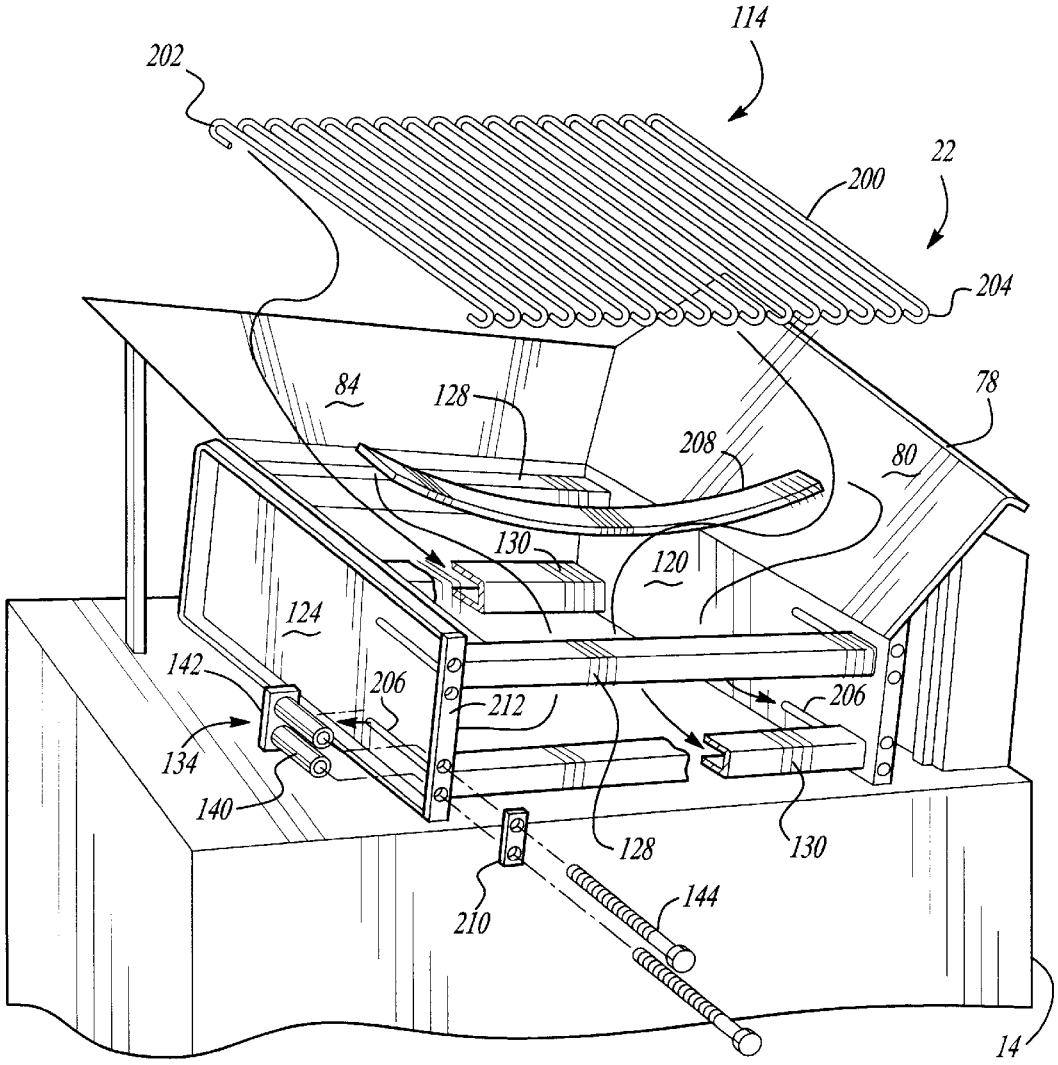
FIG. 3 is an assembly view of a lower vibrating screen box for the vibratory screening device of FIG. 1.

Referring to FIG. 3, screen assembly 22 is illustrated in further detail. Lower screen deck 114 includes a screen 200 having curved ends 202 and 204 along opposing front and rear edges thereof. Ends 202 and 204 preferably have a "U"-shaped cross-section. Cross-members 128 and 130 also preferably have a "U"-shaped cross-section. Curved end 202 of screen 200 engages an upper flange of lower rear cross member 130. Lower slots 206 in side supporting members 120 and 124 receive a plate 208. When assembled, curved end 204 of screen 200 is received inside an opening in "U"-shaped cross member 130 and engages plate 208. Opposite ends of plate 208 are positioned between first and second threaded housings 142 of tensioning devices 134. As bolts 144 are tightened, end plates 140 of tensioning devices 134 are biased against ends of plate 208 which, in turn, provides tension in screen 200. A wear plate 210 is preferably located between the heads of bolts 144 and a flange 212 of side supporting members 120 and 124 to reduce wear during vibrational operation. In a preferred embodiment, wear plate 210 is made of stainless steel to reduce rust buildup.

Figure 4:
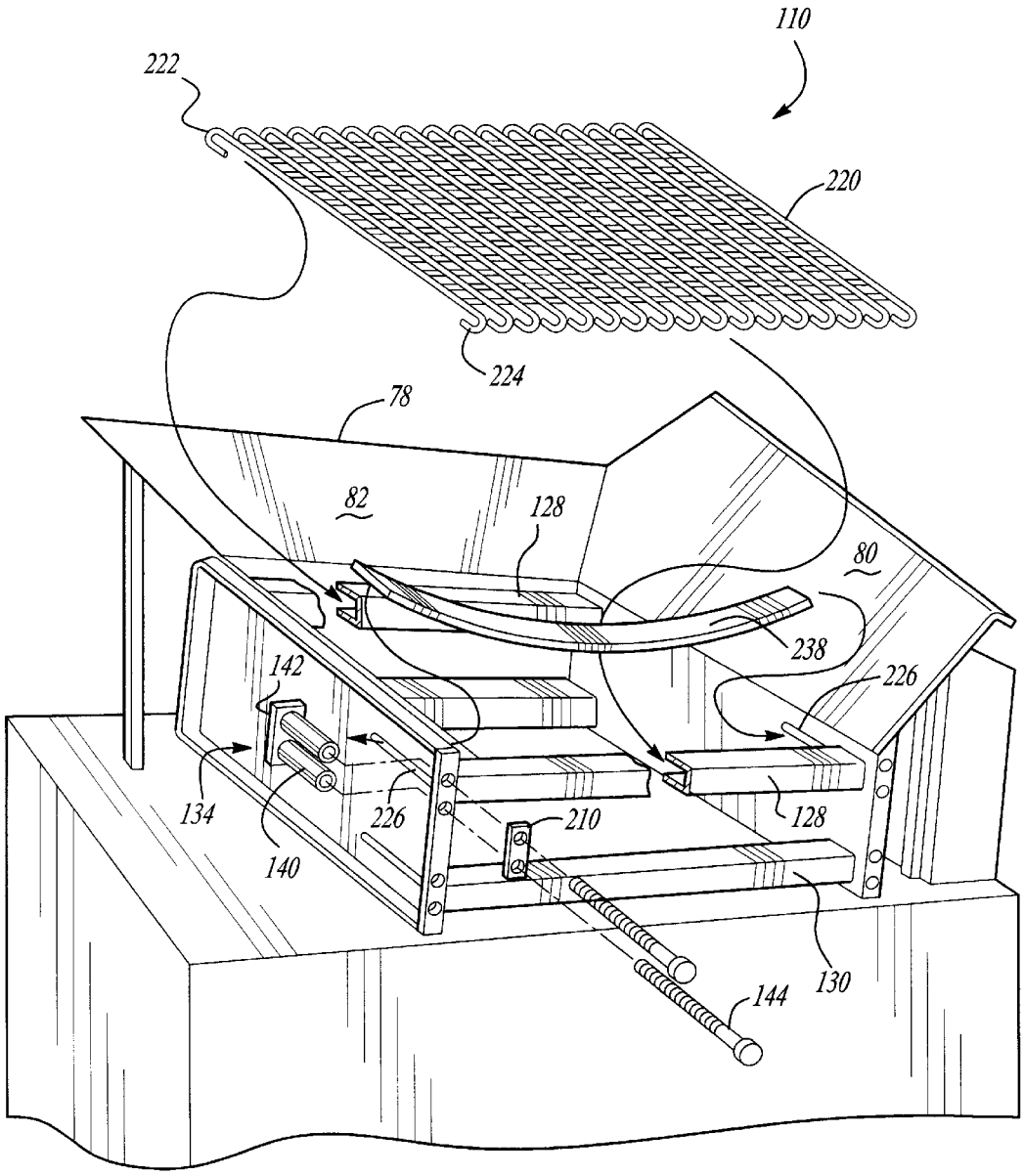
FIG. 4 is an assembly view of an upper vibrating screen box for the vibratory screening device of FIG. 1.

Referring to FIG. 4, screen assembly 22 is illustrated in further detail. Upper screen deck 110 includes a screen 220 having curved ends 222 and 224 with a "U"-shaped cross-section. Curved end 222 of screen 220 engages an upper flange of upper rear cross member 128. Upper slots 226 in side supporting members 120 and 124 receive a plate 238. When assembled, curved end 224 of screen 220 is received inside an opening in "U"-shaped cross member 130 and engages plate 238. Opposite ends of plate 238 are positioned between first and second threaded housings 142 of tensioning devices 134. As bolts 144 are tightened, end plates 140 of tensioning devices 134 are biased against ends of plate 238 which, in turn, provides tension in screen 220.

Figure 5:
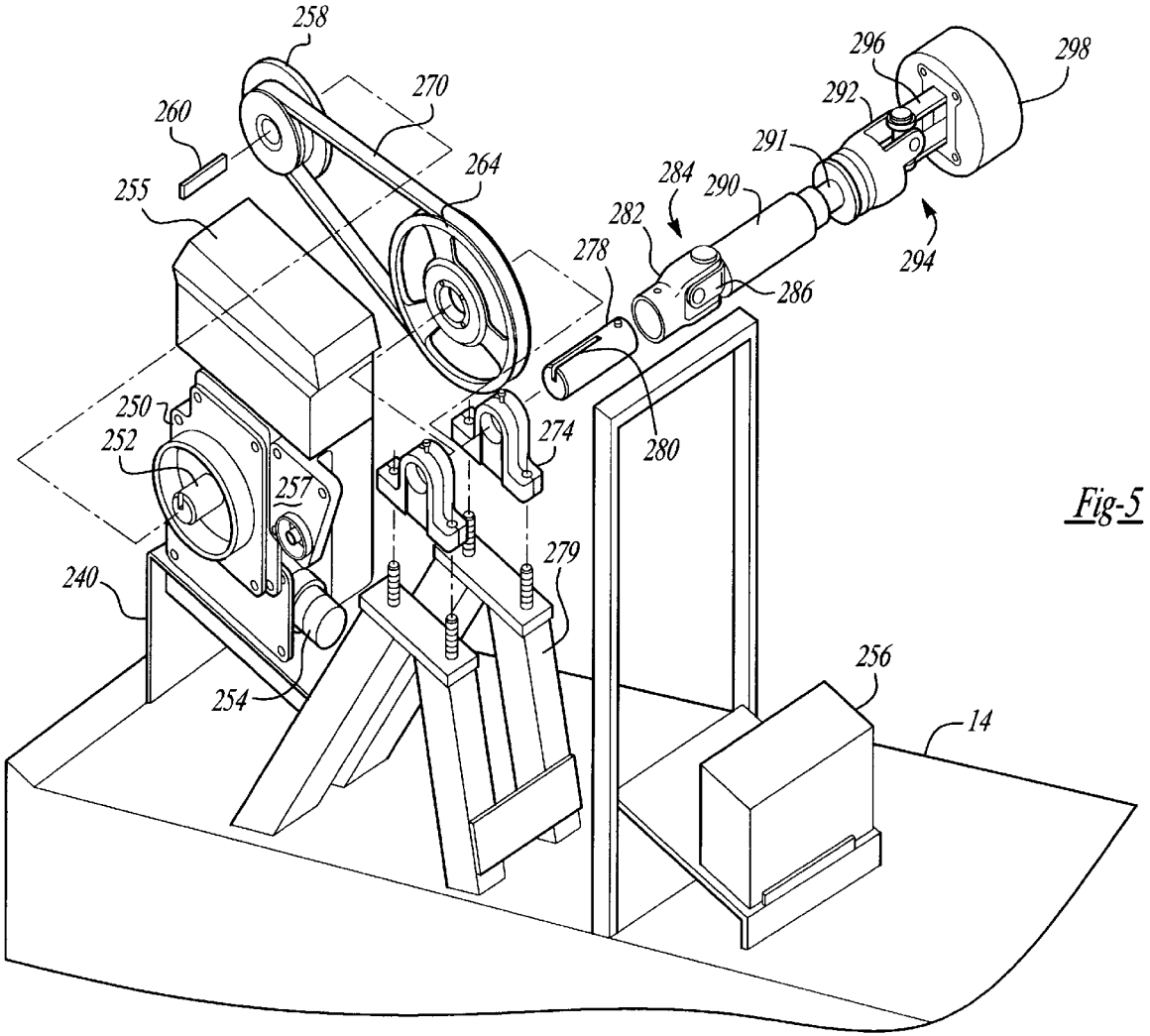
FIG. 5 is a perspective and partial assembly view of the drive system for a vibratory screening device for the vibratory screening device of FIG. 1.

Referring to FIG. 5, components contained in engine compartment 18 are illustrated in greater detail. A drive mount 240 extends upwardly from box frame 14. A drive device 250 is connected to frame 14 by a drive mount 240. Drive device 250 is preferably an internal combustion engine such as a diesel or gas engine. Skilled artisans can appreciate that an electric motor may also be employed. Drive device 250 further includes a drive shaft 252, an oil filter 254 and a fuel tank 256 (if an engine is employed), an hour meter (not shown), a battery 256, and a starter 257.

A centrifugal clutch 258 is connected to drive shaft 252. A spline 260 fixes the rotation of an inner surface of centrifugal clutch 258 and drive shaft 252. A sheave 264 is coupled to centrifugal clutch 258 by an endless belt 270. Preferably, centrifugal clutch 258 and sheave 264 reduce the rotational speed of drive shaft 252.

Sheave 264 is supported by pillow block bearings 274 that are positioned by an output shaft mounting pad 276. Pillow block bearings 274 rotatably support an output shaft 278. A keyway or spline 280 fixes the rotation of output shaft 278 and sheave 264. Output shaft 278, in turn, is fixedly connected for rotation to a first coupling 282 of a first universal joint ("U-joint") 284. A second coupling 286 of first universal joint 284 is connected to one end of a secondary output shaft 290. An opposite end of secondary output shaft 290 is coupled to a sliding spline shaft 291 to allow some axial movement of output shaft 290 relative to a first coupling 292 of a second universal joint 294. Second U-joint is preferably rotated 90 degrees relative to first U-joint 284. A second coupling 296 of second universal joint 294 is coupled to a cylindrical coupler 298.

Figure 6:
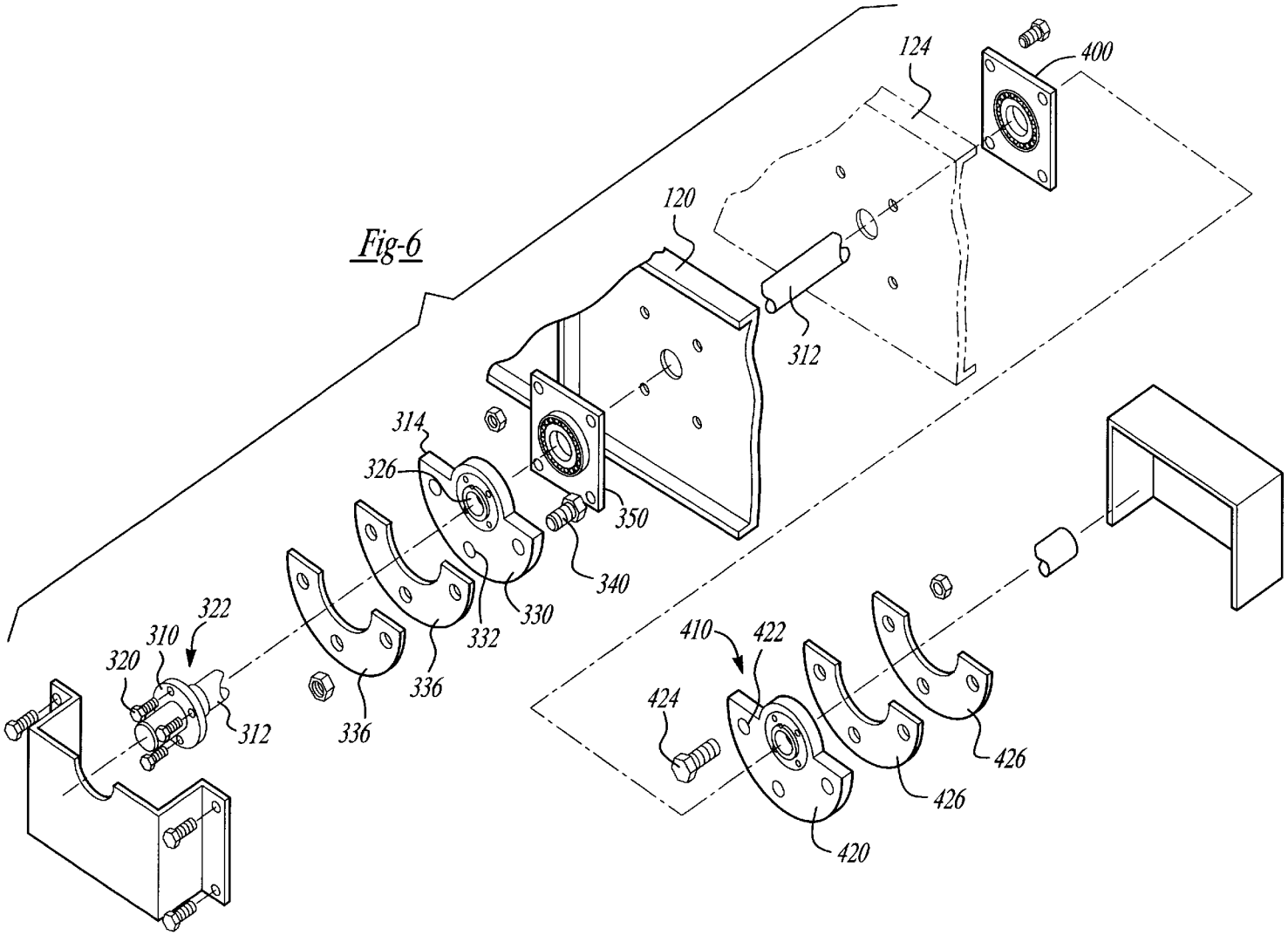
FIG. 6 is an assembly view of an eccentric output shaft for the vibratory screening device of FIG. 1.
Figure 7:
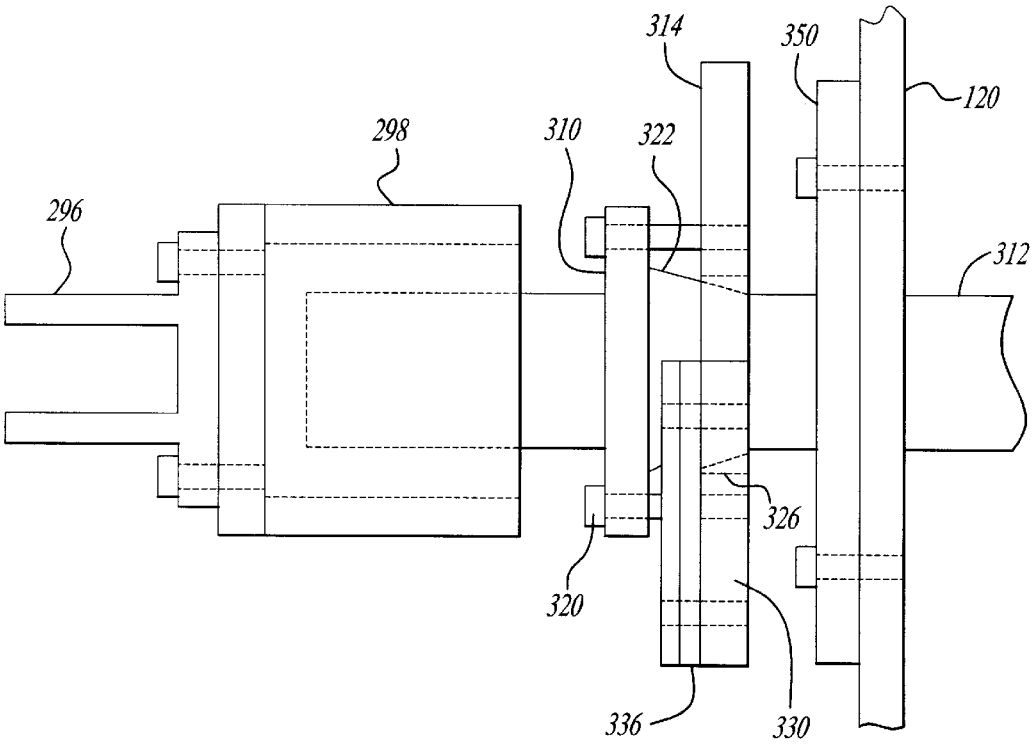
FIG. 7 is a partial plan view of a connection between the drive system and the eccentric shaft for the vibratory screening device of FIG. 1.

Referring to FIGS. 6 and 7, cylindrical coupler 298 is fixedly connected for rotation to a tertiary output shaft 312 using one or more keyways or splines (not shown). Skilled artisans can appreciate that the connection can be made using bolts, welding or other suitable connectors. A male taper lock fitting 312 is positioned over tertiary output shaft 312. A female taper lock fitting 314 is likewise positioned over shaft 312 and is frictionally connected to male taper lock fitting 310 using one or more fasteners 320 such as bolts. As fasteners 320 are tightened, an inclined surface 322 abuts an inner surface 326 of female taper lock fitting 314. Female taper lock fitting 314 includes a semicircular flange portion 330 that includes bores 332. Eccentric weights 336 preferably include bores 338 and are connected to semicircular flange portion 330 using fasteners 340. In a preferred embodiment, fasteners 340 are bolts that are received by bores 332 and 338. A flange bearing 350 is connected to an outer surface of side supporting member 120. Tertiary output shaft 312 is partially supported for rotation by flange bearing 350.

Adjacent side supporting member 124, a second flange bearing 400 is connected to an outer surface of side supporting member 124. Tertiary output shaft 312 is additionally supported for rotation by flange bearing 400. A female taper lock fitting 410 is connected to male taper lock fitting (not shown) using one or more fasteners in a manner similar to fittings 310 and 314. Female taper lock fitting 410 likewise includes a semicircular flange portion 420 that includes bores 422. Eccentric weights 426 are connected to semicircular flange portion 420 using fasteners 424.

In use, an operator simply turns a key (not shown) located on an outer surface of engine compartment 18. As drive 250 begins rotating, centrifugal clutch 258 begins to engage and rotate endless belt 270 and sheave 264. Sheave 264, in turn, rotates output shaft 278, first U-joint 284, sliding spline shaft 291, and second U-joint 294.

As eccentric weights 336 and 426 rotate with shaft 312, a rotational imbalance occurs in first and second planes transverse to the axis of rotation of shaft 312. The imbalance is roughly proportional to the weight of eccentric weights and the rotational speed of output shaft 312. Due to the rotational imbalance, screen box 22 begins to gyrate on springs 180 in a plane transverse to the axis of rotation of output shaft 312. U-joints 284 and 294 permit transmission of torque from the transversely static axis of rotation of output shaft 278 to the transversely dynamic axis of rotation of output (eccentric) shaft 312. Movement of output shaft 312 in a plane transverse to the output shaft axis during vibration is absorbed by U-joints 284 and 294. Axial movement of output shaft 312, in turn, is absorbed by sliding spline shaft 291.

As screen box 22 vibrates, undersize material (smaller than the openings in upper screen 220) falls through upper screen onto lower screen 200. Oversize material vibrates towards the front of frame 14 and falls off the front edge of upper screen 220. Material falling onto lower screen 200 is screened in a similar manner.

As can be appreciated, portable material screening plant 10 can easily be equipped with various size meshes for screen decks 110 and 114 for different materials to be screened. The non-hydraulic drive system is both inexpensive, more environmentally friendly, more durable and more efficient than conventional hydraulic drive systems. In addition, maintenance of the drive system is far more simple and inexpensive when compared to hydraulic drive systems. The start-up procedure is more simple and safe than hydraulic systems because the engine compartment need not be opened during startup.

While the foregoing preferred embodiments of the invention have been described and shown, it is understood that alternatives and modifications, such as those suggested and others, may be made thereto and fall within the scope of the invention.

What is claimed is:

1. A vibratory screening device for separating heavy materials including loam comprising oversize and undersize material wherein said loam is dumped onto said vibratory screening device using a loading apparatus comprising a wheel loader, a skid steer or a conveyor, said vibratory screening device comprising:

a supporting frame;

a screen box supported by said frame and including a material separating screen;

means for processing loam comprising a horizontal eccentric shaft that rotates relative to said screen box such that horizontal construction minimizes strain imposed by processing said heavy materials;

a drive system; and connecting means for coupling said eccentric shaft to said drive system, wherein said connecting means includes a universal joint.

2. The vibratory screening device of claim 1, wherein said drive system includes:

an engine having an output shaft; and a centrifugal clutch coupled to said output shaft.

3. The vibratory screening device of claim 2 further comprising:

a sheave; and an endless belt connecting said centrifugal clutch to said sheave.

4. The vibratory screening device of claim 3 further comprising:

a mounting pad connected to said frame;

first and second pillow block bearings connected to said mounting pad; and a first output shaft having a first portion rotatably supported by said first pillow block bearing and a second portion rotatably supported by said second pillow block bearing, wherein said sheave is supported between said first and second portions.

5. The vibratory screening device of claim 4 wherein a third portion of said first output shaft is coupled to a first coupling of said first universal joint.

6. The vibratory screening device of claim 5 further comprising:

a sliding spline shaft coupled to a second coupling of said first universal joint; and a second universal joint having a third coupling connected to said sliding spline shaft.

7. The vibratory screening device of claim 6 wherein said second universal joint includes a fourth coupling connected to said eccentric shaft.

8. A vibratory screening device for separating heavy materials comprising loam that includes oversize and undersize material, wherein said loam is dumped on said vibratory screening device using a loading apparatus including a wheel loader, a skid steer or a conveyor, said vibratory screening device comprising:

a frame;

screening means, supported by said frame, for separating undersize material from oversize material;

a horizontally positioned eccentric shaft constructed to minimize strain imposed by processing said heavy materials;

drive means for providing rotary output; and connecting means for coupling said drive means and said vibrating means, wherein said connecting means includes a universal joint.

9. A vibratory screening device for separating loam comprising oversize and undersize material wherein said loam is dumped onto said vibratory screening device using a loading apparatus including a wheel loader, a skid steer or a conveyor, said vibratory screening device comprising:

a frame;

screening means, supported by said frame, for receiving said loam dumped by said loading apparatus for separating said undersize and oversize material;

vibrating means, coupled to said screening means and including a first output shaft with an axis of rotation that oscillates relative to said frame, for oscillating said screening means as said first output shaft is rotated;

drive means, including a second output shaft with an axis of rotation that is fixed relative to said frame, for rotating said first output shaft; and connecting means for mechanically coupling rotational output of said first output shaft to said second output shaft wherein said connecting means includes a first universal joint, a sliding spline shaft coupled to said first universal joint and a second universal joint coupled to said sliding spline shaft.

10. The vibratory screening device of claim 8, wherein said drive means includes:

an engine; and a centrifugal clutch coupled to said first output shaft.

11. The vibratory screening device of claim 10 wherein said drive means further comprises:

a sheave; and an endless belt connecting said centrifugal clutch to said sheave.

12. The vibratory screening device of claim 11 further comprising:

a mounting pad connected to said frame;

first and second pillow block bearings connected to said mounting pad; and a third output shaft having a first portion supported by said first pillow block bearing and a second portion supported by said second pillow block bearing, wherein said sheave is supported between said first and second portions.

13. The vibratory screening device of claim 12 wherein a third portion of said first output shaft is coupled to a first coupling of a first universal joint.

14. The vibratory screening device of claim 13 further comprising:

a sliding spline shaft coupled to a second coupling of said first universal joint; and a second universal joint having a third coupling connected to said sliding spline shaft.

15. The vibratory screening device of claim 14 wherein said second universal joint includes a fourth coupling connected to said eccentric shaft.

* * * * *